US008585261B2

(12) United States Patent
Schug

(10) Patent No.: US 8,585,261 B2
(45) Date of Patent: Nov. 19, 2013

(54) LAMP ASSEMBLY

(75) Inventor: Josef Andreas Schug, Wuerselen (DE)

(73) Assignee: Koninklijke Philips N.V., Eindhoven (NL)

( * ) Notice: Subject to any disclaimer, the term of this patent is extended or adjusted under 35 U.S.C. 154(b) by 177 days.

(21) Appl. No.: 12/988,532

(22) PCT Filed: Apr. 20, 2009

(86) PCT No.: PCT/IB2009/051616

§ 371 (c)(1),
(2), (4) Date: Oct. 19, 2010

(87) PCT Pub. No.: WO2009/130655

PCT Pub. Date: Oct. 29, 2009

(65) Prior Publication Data

US 2011/0038168 A1 Feb. 17, 2011

(30) Foreign Application Priority Data

Apr. 25, 2008 (EP) ..... 08103728

(51) Int. Cl.
*F21V 21/28* (2006.01)

(52) U.S. Cl.
USPC ..... 362/465; 362/507; 362/509; 362/516; 362/517; 362/539

(58) Field of Classification Search
USPC ..... 362/465, 507, 509, 516–520, 539
See application file for complete search history.

(56) References Cited

U.S. PATENT DOCUMENTS

| | | | | |
|---|---|---|---|---|
| 3,999,056 | A * | 12/1976 | Faulhaber | 362/263 |
| 5,428,512 | A * | 6/1995 | Mouzas | 362/466 |
| 6,882,110 | B2 * | 4/2005 | Ishida et al. | 315/82 |
| 7,178,959 | B2 | 2/2007 | Capello et al. | |
| 7,252,418 | B2 | 8/2007 | Enders | |
| 7,810,975 | B2 * | 10/2010 | Specht et al. | 362/555 |
| 7,923,377 | B2 * | 4/2011 | Saito et al. | 438/758 |
| 2005/0018436 | A1 | 1/2005 | Leleve | |

(Continued)

FOREIGN PATENT DOCUMENTS

| | | | |
|---|---|---|---|
| DE | 19923187 | C2 | 5/2001 |
| DE | 102004007812 | A1 | 9/2005 |
| DE | 102004056314 | A1 | 6/2006 |
| DE | 202007001829 | U1 | 6/2007 |
| EP | 1270324 | A2 | 1/2003 |
| EP | 1403135 | A2 | 3/2004 |
| EP | 1707438 | A1 | 10/2006 |
| EP | 1881264 | A1 | 1/2008 |
| EP | 1936260 | A1 | 6/2008 |
| WO | 0101038 | A1 | 1/2001 |
| WO | 2004088201 | A1 | 10/2004 |
| WO | 2007060319 | A1 | 3/2007 |
| WO | 2007122544 | A1 | 11/2007 |

*Primary Examiner* — Jong-Suk James Lee
*Assistant Examiner* — Mark Tsidulko
(74) *Attorney, Agent, or Firm* — John F. Salazar; Mark L. Beloborodov

(57) ABSTRACT

It is provided a lamp assembly (10) for an automotive headlamp, comprising at least two lamps (12) each comprising a light source (14) for emitting light rays, wherein the respective light rays (16) of each lamp (12) are bordered in horizontal direction mainly orthogonal to its lighting direction by a guiding element (20), and a single shield (24) comprising a mainly horizontal top surface (22) for bordering the light rays (16) of at least two lamps (12) in one vertical direction, wherein the shield (24) is arranged such that the light rays (16) of two adjacent lamps (12) overlap at the top surface (22) of the shield (24). Since the light rays (16) of two neighboring lamps (12) overlap at the top surface (22) of the shield, it is possible to provide a smooth change of the brightness between an area illuminated by two lamps (12) and an area illuminated by only one lamp (12). Due to the smooth change of the brightness the lamp assembly (10) provides an easily to perceived illuminated area (30).

6 Claims, 2 Drawing Sheets

(56) References Cited

U.S. PATENT DOCUMENTS

2005/0122736 A1* 6/2005 Watanabe et al. ..... 362/542
2005/0219856 A1* 10/2005 Tatsukawa ..... 362/507
2005/0237758 A1* 10/2005 Takeda et al. ..... 362/512
2006/0002130 A1 1/2006 Albou
2007/0211486 A1 9/2007 Bernard et al.
2007/0231504 A1* 10/2007 Wu ..... 428/1.3

* cited by examiner

LAMP ASSEMBLY

FIELD OF THE INVENTION

The invention relates to the field of lamp assemblies, which may be used for an automobile as headlamp.

BACKGROUND OF THE INVENTION

From US 2005/0018436 A1 a lamp assembly is known, which comprises several lamps arranged side by side. Each lamp comprises a light-emitting diode (LED) and a reflector, which reflects light rays emitted by the LED lamp to a reflective plate, which is arranged inside a lamp housing of the lamp in line to the optical axis of the lamp. Due to the reflective plate a sharp bright/dark-cutoff is provided. The light rays leave the lamp through a lens, by which the lamp housing is closed in lighting direction of the lamp. The several lamps are arranged such that the cones of light of adjacent lamps partially overlap at an area in front of the automobile. This leads to an illuminated area in front of the automobile, which can be very broad, so that even a curve of a road may be illuminated by several lamps of the lamp assembly.

It is a disadvantage of such kind of a lamp assembly that the illuminated area illuminated by the several lamps of the lamp assembly comprises stepwise changes of the brightness. Due to the fact that a part of the illuminated area is significant brighter than another part, which is significant darker, a driver is hampered to perceive the whole illuminated area, since he may be blinded by the one part of the illuminated area, while the other part may be too dark to be perceived.

SUMMARY OF THE INVENTION

It is an object of the invention to provide a lamp assembly for an automotive headlamp, which provides an easily to perceived illuminated area. It is particularly an object of the invention to provide a lamp assembly for an automotive headlamp, which provides a sharp bright/dark-cutoff and which is easy to be assembled. It is preferably an object of the invention to provide a lamp assembly for an automotive headlamp, which can be easily adapted to broaden and/or shift the illuminated area for illuminating a curve of a road.

This object is achieved by a lamp assembly for an automotive headlamp, comprising at least two lamps each comprising a light source for emitting light rays, wherein the respective light rays of each lamp are bordered in horizontal direction mainly orthogonal to its lighting direction by a guiding element, and a single shield comprising a mainly horizontal top surface for bordering the light rays of at least two lamps in one vertical direction, wherein the shield is arranged such that the light rays of two adjacent lamps overlap at the top surface of the shield.

Due to the guiding element, which may be provided by a lens, an aperture and/or bordering side walls, the emitted light rays comprise a definite border in at least horizontal direction as well as a predefined direction. Since the light rays of two neighboring lamps overlap at the top surface of the shield, particularly at the edge of the shield, it is possible to provide a smooth change of the brightness between an area illuminated by two lamps and an area illuminated by only one lamp. This can be provided for instance by a scattering surface of the shield and/or by an optical element with a scattering property. Due to the smooth change of the brightness stepwise changes of the brightness of the illuminated area in front of an automobile is prevented. This reduces the risk that a driver may be blinded by the one part of the illuminated area, while the other part may be too dark to be perceived. Due to the smooth change of the brightness an automotive headlamp is provided, which provides an easily to perceived illuminated area. The shield with the horizontal top surface pointing to the lamps provides at the same time a sharp bright/dark-cutoff in vertical direction. Further the luminous flux slightly above the top surface of the shield is increased, since the luminance in this area may comprise directly emitted light rays as well as light rays reflected by the shield. Due to this effect the luminous flux nearby the bright/dark-cutoff is increased, so that a decrease of the brightness in an illuminated area far away from the driver may be compensated leading to a mainly constant luminance independently from the distance of the illuminated area. Thus, the perception not only transverse to the driving direction and/or the optical axis of the lamps is increased but also the perception in driving direction and/or in line to the optical axis of the lamps. Since a single shield for several lamps is provided it is not necessary to provide each lamp with its own shield. Further it is not necessary to provide every lamp with its own exit optics, since a single optical element as common exit optics is sufficient. This leads to a reduced number of assembling parts and leads to a facilitated assembling. Further it safeguards, that all lamps comprise the same bright/dark-cutoff. Even when a lamp is not correctly aligned for instance after a replacement of a defect lamp, a correctly aligned bright/dark-cutoff is provided by the shield, so that it is safeguarded that an oncoming driver may not be blinded by a lamp of the lamp assembly. It is not necessary to align every lamp separately. Further it is possible to broaden the illuminated area by turning on or off specific lamps of the lamp assembly. Thus, it is possible to illuminate a curve of a road, which a driver wants to take.

Preferably the shape of the top surface and/or the extend of the top surface illuminated by the lamps and/or the reflective properties of the top surface are chosen such that the decrease of the brightness in an illuminated area far away may be mainly compensated with respect to a nearer illuminated area. This leads to a mainly constant luminance independently from the distance of the respective part of the illuminated area to the driver.

Particularly the shield protrudes in horizontal direction with respect to the guiding elements. An overlap of the emitted light rays may only occur outside the lamps. It is not necessary to provide a transfer of light rays between to adjacent lamps through a part of a lamp housing or through the guiding element. This leads to an easily to assemble design of the lamps. Further the lamps may comprise a longer extension in lighting direction, so that a sharp border in horizontal direction may be provided by the guiding element. The shape of the illuminated area may be more precisely adjusted.

In a preferred embodiment the top surface of the shield is at least partially reflective. Since the light rays hitting the top surface of the shield are not absorbed but reflected, the luminance of the respective lamps can be increased. This leads to an increased optical efficiency of the lamp assembly.

Particularly a single optical element for guiding the light rays of at least two lamps is provided, wherein the optical element is particularly adapted for at least partially focusing the light rays in horizontal and/or vertical direction. Due to the optical element it is possible to provide a smooth change of the brightness between an area illuminated by two lamps and an area illuminated by only one lamp. Particularly the smooth change is only provided by the optical element without a scattering filter or the like. Preferably the light rays are at least partially focused in horizontal direction and at least partially focused in vertical direction. A sharp bright/dark-cutoff and a broadened illuminated area may be provided at the same time. The optical element may be a cylinder lens or a Fresnel structure. Particularly the optical element is shaped as curved cylinder lens. Most preferred the shield comprises a bordering edge for bordering the top surface in lighting direction and the optical element comprises a focal point arranged at the bordering edge within an area spaced to the bordering edge in lighting direction by a distance Δd, which is −10 mm≤Δd≤10 mm, particularly −5 mm≤Δd≤5 mm and preferably −2 mm≤Δd≤2 mm. Arranging the focal point of the optical element near to the bordering edge of the shield leads to an unsharpness of the image of the light sources by means of the optical element. Due to the unsharpness the change of brightness of adjacent illuminated areas is smoother.

Preferably the light source of at least two lamps comprises a LED-lamp, wherein the LED-lamps are connected to a common substrate, wherein the substrate is particularly connected to the shield. Due to the substrate it is possible to arrange the LED-lamps mainly orthogonal to the shield, so that a sharp bright/dark-cutoff is safeguarded. Further less assembling steps a required to assemble the lamp assembly, since all light sources may by positioned by means of the single substrate. Since the LEP-Lamps may be provided as plate-like LED-chips, a strong connection may be provided between the LED-lamp and the substrate for instance by bonding. Particularly the substrate may lead away heat from the LED-lamps safeguarding a long life time of the LED-lamps. Preferably the head led away from the LED-lamps may be led to the shied by means of heat conduction, so that the shield may also cool the LED-lamps.

Particularly the guiding element of the lamp comprises a first side wall and a second side wall for providing a defined emission angle for the light rays and/or for providing a defined width of the light rays. Due to an easily to perform guiding element the light rays are bordered in horizontal direction in a defined manner. If so, the side walls may be part of a reflector and/or part of a lamp housing.

Preferably the shield is plate-like and the top surface is particularly at least a part of a mainly circular area. The manufacture of the shield is facilitated. For instance the shield may be manufactured by stamping the shield from a metal sheet. Particularly the bordering edge of the shield is concentric to an optical element shaped as curved cylinder lens.

The invention further relates to a headlamp for an automobile, comprising a lamp assembly, which may be designed as previously described. Due to the lamp assembly the headlamp provides an easily to perceived illuminated area. Preferably the lamps are mainly arranged spaced and/or side by side in horizontal direction and electrically connected to a control unit, wherein the control unit is adapted to provide the lamps with electrical energy in dependence to a driving parameter of the automobile, particularly a turning angle of a steering wheel and/or the activation of a turn indicator. Thus, the headlamp can be easily adapted to broaden and/or shift the illuminated area for illuminating a curve of a road. For instance when a driver turns the steering wheel, the headlamp may automatically illuminate a part of the road, particularly a curve, which is arranged beside the actual driving direction. The driving safety can be increased. Preferably the control unit is adapted to apply and/or terminate electrical energy to the lamps in a sequential order, which corresponds to the sequential order of the lamps in horizontal direction. Thus it is possible to provide a very broad illuminated area and/or to illuminate an area arrange significantly besides the actual driving direction, when the steering wheel is turned along a greater turning angle of the steering wheel. The illuminated area may be adapted to the actual driving situation, particularly the intended driving direction.

The invention further relates to an automobile comprising a headlamp, which may be designed as previously described and a sensor for detecting the turning angle of the steering wheel and/or for detecting the activation of a turn indicator, wherein the sensor is connected to the control unit and the control unit is adapted to apply and/or terminate electrical energy to the lamps in such a sequential order that an area in front of the automobile is illuminated into which the automobile is going according to the turning angle of the steering wheel and/or the activation of the turn indicator. Due to the headlamp the illuminated area may be adapted to the actual driving situation, particularly the intended driving direction, while an easily to perceived illuminated area is provided at the same time.

BRIEF DESCRIPTION OF THE DRAWINGS

These and other aspects of the invention will be apparent from and elucidated with reference to the embodiments described hereinafter.

In the drawings.

DETAILED DESCRIPTION OF EMBODIMENTS

Figure 1:
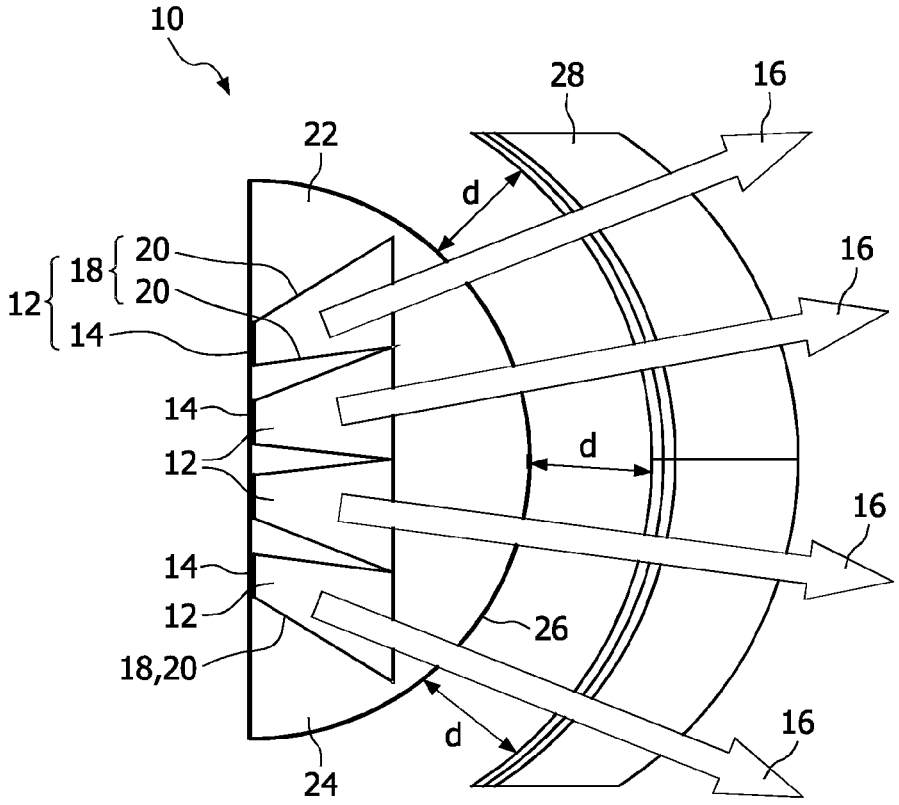
FIG. 1 is a schematic top view of a lamp assembly according to the invention.

The lamp assembly 10 illustrated in FIG. 1 comprises four lamps 12 arranged adjacent side by side in a horizontal plane. Each lamp 12 comprises a LED-chip as light source 14 for emitting light rays 16 and a housing 18 by which guiding elements 20 are provided for bordering the light rays 16 in horizontal direction. Due to the guiding elements 20, which are the side walls of the housing 18 in the illustrated embodiment, the emission angle as well as the width of the light rays 16 is defined. In the illustrated embodiment only light rays 16 are illustrated located mainly in the optical axis of the lamp 12 for purpose of clarity.

The lamps 12 are arranged onto a top surface 22 of a single plate-like half-circular shield 24. The shield 24 comprises a bordering edge 26 in lighting direction, which is spaced to the guiding elements 20 of the housing 18 of each lamp 12, so that the light rays 16 of two adjacent lamps 12 may overlap at the top surface 22 of the shield 24.

The lamp assembly 10 further comprises an optical element 28, which is designed as bended half cylinder lens in the illustrated embodiment. The optical element 28 is arranged spaced to the bordering edge 26 of the shield 24 at a mainly constant distance d. This distance d corresponds mainly to the focal distance of the optical element 28. This means the focal point of the optical element 28 is mainly arranged at the bordering edge 26 of the shield, wherein a tolerance Δd of a few millimeters is still possible.

Figure 2:
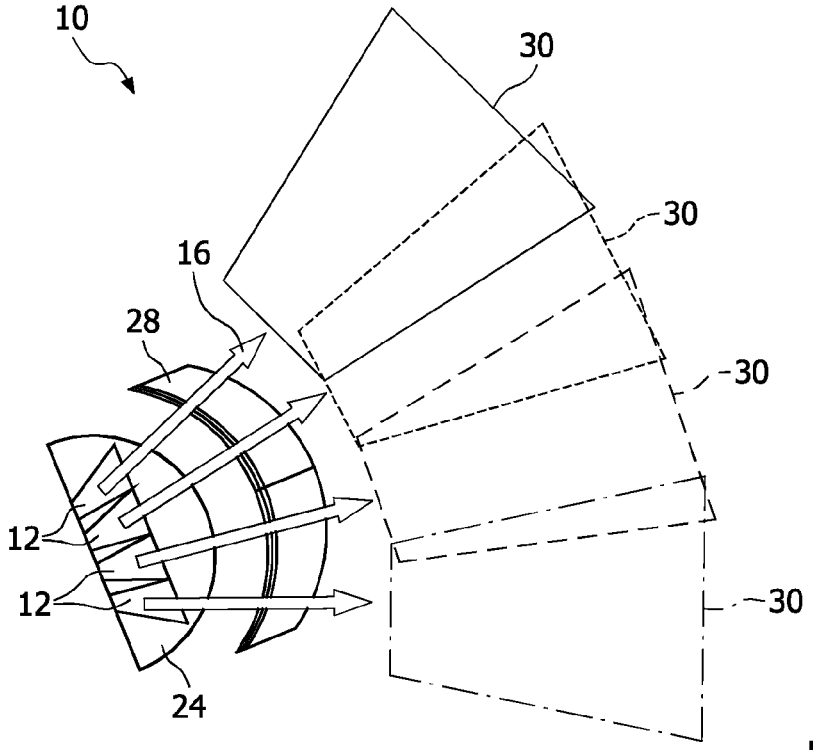
FIG. 2 is a schematic top view of the lamp assembly of FIG. 1 at a larger scale.

As illustrated in FIG. 2 each lamp 12 provides an illuminated area 30, which may partially overlap, wherein the change of brightness between neighboring areas is smoother due to the overlapping of the light rays 16 at the shield 24 before imaging the light rays 16 by the optical element 28. When adjacent lamps 12 are turned on one by one the illuminated area 30 can be broadened at will, for instance when an automobile with a headlamp comprising the lamp assembly 10 is going to take a curve of a road or the like, so that the curve may be illuminated by the lamp assembly 10.

Figure 3:
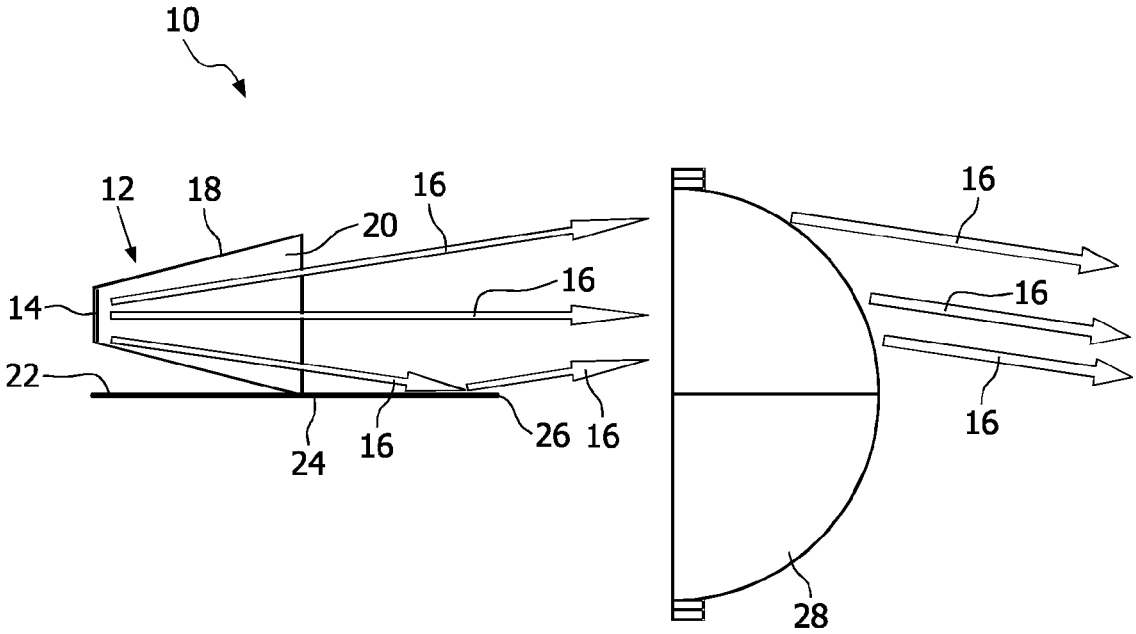
FIG. 3 is a schematic side view of the lamp assembly of FIG. 1

As illustrated in FIG. 3 the top surface 22 of the shield 24 may reflect a light ray 16. This leads to an increased luminous flux near to the shied 24, which can be collimated by the optical element 28. Due to the protruding shield 24 with respect to the lamp 12 or the housing 18 a sharp bright/dark-cutoff is provided, wherein the luminous flux at the bright/dark-cutoff is increased. Since in an automobile the bright/dark-cutoff is imaged far away from the automobile a mainly constant luminance independent from the distance may be provided.

Figure 4:
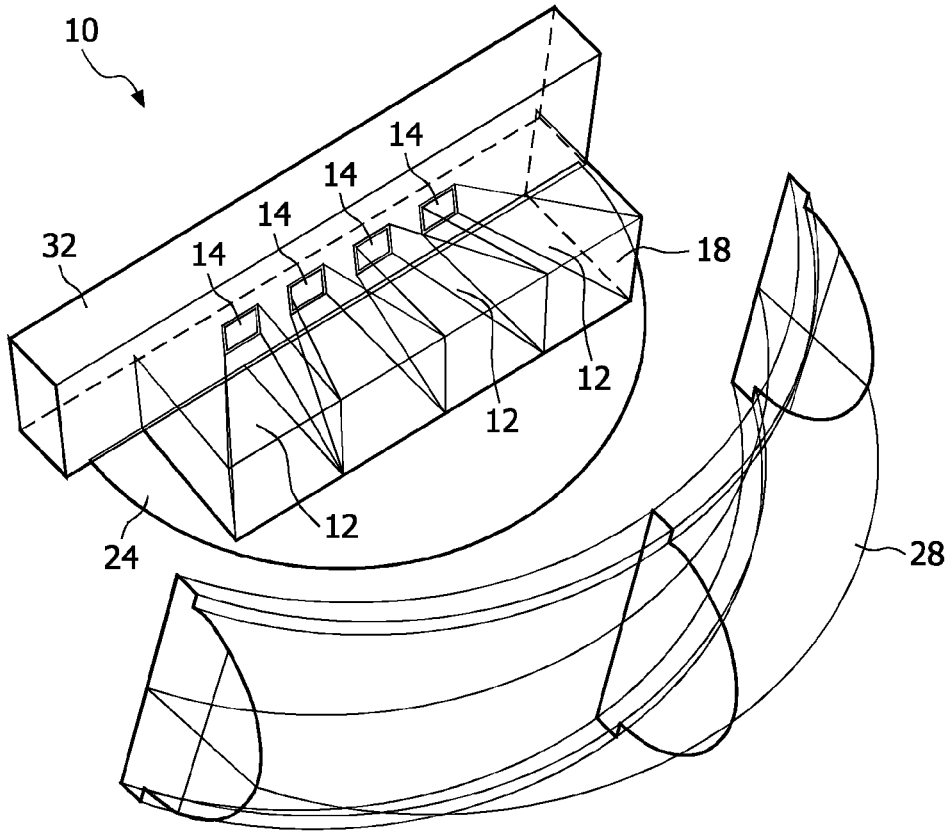
FIG. 4 is a schematic perspective view of the lamp assembly of FIG. 1.

As illustrated in FIG. 4 all lamps 12 are connected to a single substrate 32. Particularly the LED-chips 14 are directly connected to the substrate 32 for cooling purposes. The housings 18 of the lamps 12 and the shield 24 may also be connected to the substrate 32 for providing a single assembling unit.

While the invention has been illustrated and described in detail in the drawings and foregoing description, such illustration and description are to be considered illustrative or exemplary and not restrictive; the invention is not limited to the disclosed embodiments. For example, it is possible to operate the invention in an embodiment wherein the illustrated lamp assembly 10 is arranged upside down, so that the top surface 22 of the shield 24 points downwards. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A lamp assembly for an automotive headlamp, comprising:

a plurality of LEDs each positioned on a substrate in adjacent side by side relationship, each of said plurality of LEDs having a guiding element extending in a light output direction;

each of said guiding element having a first side wall and a second side wall for providing a defined emission angle and width for light emitted by each of said respective LED;

a unitary semi-circular shield having a light entry surface for each of said plurality of LEDs;

wherein said shield has a bordering edge spaced away from said guiding elements in said light output direction so that light from adjacent of said LEDs overlaps at said bordering edge;

a semi-circular optical element spaced away from said bordering edge of said shield at a substantially constant distance corresponding to a focal distance of said optical element such that the focal point of said optical element is substantially positioned at said bordering edge of said shield and said bordering edge of said shield is substantially concentric with said optical element.

2. The lamp assembly of claim 1 wherein said focal distance is a distance d in said light output direction which is $-10\ \text{mm} \leq d \leq 10\ \text{mm}$.

3. The lamp assembly of claim 1 wherein said focal distance is a distance d in said light output direction which is $-5\ \text{mm} \leq d \leq 5\ \text{mm}$.

4. The lamp assembly of claim 1 wherein said focal distance is a distance d in said light output direction which is $-2\ \text{mm} \leq d \leq 2\ \text{mm}$.

5. The lamp assembly of claim 1 wherein said optical is a curved cylinder lens.

6. The lamp assembly of claim 1 wherein said shield has a top surface which is at least partially reflective increasing the luminance of each respective of said plurality of said LEDs.

* * * * *